US006663458B1

(12) United States Patent
Jauregui

(10) Patent No.: US 6,663,458 B1
(45) Date of Patent: Dec. 16, 2003

(54) TUB TOY RECEPTACLE

(76) Inventor: Sally A. Jauregui, 666 N. El Cerrito Dr., Brawley, CA (US) 92227

( * ) Notice: Subject to any disclaimer, the term of this patent is extended or adjusted under 35 U.S.C. 154(b) by 0 days.

(21) Appl. No.: 10/242,836

(22) Filed: Sep. 13, 2002

(51) Int. Cl.[7] ..... B65D 79/00
(52) U.S. Cl. ..... 446/73; 446/76; 206/457
(58) Field of Search ..... 446/71, 72, 73, 446/74, 75, 76; 206/457, 77.1

(56) References Cited

U.S. PATENT DOCUMENTS 5,201,443 A * 4/1993 Oswald ..... 223/85
5,381,564 A * 1/1995 Carroll ..... 4/559
5,823,366 A * 10/1998 Bellamy ..... 211/119.011

* cited by examiner

*Primary Examiner*—Jacob K. Ackun

(57) ABSTRACT

An ornamental device for holding wet bathtub toys near their point of use and in such a manner as to allow them to dry between uses. To attain this, a receptacle base designed to rest against the inner bathtub sidewall includes a character head and a hook for placement atop the bathtub sidewall. The tub edge hook may be in the shape of a character's legs. Also attached to the receptacle base will be a receptacle within which to store the toys. Such receptacle may be in the shape of a character's torso. Optionally, the device may include net.

4 Claims, 4 Drawing Sheets

TUB TOY RECEPTACLE

BACKGROUND OF THE INVENTION

1. Field of the Invention

The present invention relates to a tub toy receptacle for use in connection with storing items normally used for children's baths. The tub toy receptacle has particular utility in connection with storing wet toys such that they may dry.

2. Description of the Related Art

Tub toy receptacles are desirable for storing wet toys in a way that they can dry while being gathered to give the bath tub a neat appearance. However, such receptacles may only be useful if they are used. Consequently, a tub toy receptacle having a "child-pleasing" design is desirable as a child will be more likely to use it.

The use of toy storage units is known in the prior art. For example, U.S. Pat. No. 5,702,003 to Springer discloses a bath toy storage unit that has a storage chamber that stores bath toys for tidy clean up after a bath.

U.S. Pat. No. 5,772,490 to Leach discloses a bath entertainment center that provides an interactive surface on the inside of a bathtub where toys can be removably attached. The entertainment center is designed to substantially cover an inside wall, a ledge, and an outside wall of a bathtub. However, the Leach '490 patent does not include a base upon which is mounted a tub-edge hook and a toy receptacle configured to hang upon the bathtub sidewall.

U.S. Pat. No. 3,867,971 to Hazan discloses a combination handbag and toy that has a container that supports part of the toy. However, the Hazan '971 patent does not include a base upon which is mounted a tub-edge hook and a toy receptacle configured to hang upon the bathtub sidewall.

U.S. Pat. No. 5,381,564 to Carroll discloses a bath and shower splashguard that can store articles used in bathing. However, the Carroll '564 patent does not include a base upon which is mounted a tub-edge hook and a toy receptacle configured to hang upon the bathtub sidewall.

U.S. Design Pat. No. 265,152 to Bruno et al. discloses a toy holder for use in bathtubs, showers or the like. However, the Bruno et al. '152 patent does not appear to disclose all the features described in the instant application.

Lastly, U.S. Design Pat. No. 316,646 to Cunningham discloses a bathtub caddy that appears as though it may accommodate toys. However, the Cunningham '646 patent does not appear to disclose all the features described in the instant application.

While the above-described devices fulfill their respective, particular objectives and requirements, the aforementioned patents do not describe a tub toy receptacle that allows for storage of toys within a character-shaped device. The Leach '490 patent makes no provision for storage of toys within a character-shaped device configured to hang upon the bathtub sidewall.

Therefore, a need exists for a new and improved tub toy receptacle that can be used for storage of toys within a character-shaped device configured to hang upon the bathtub sidewall. In this regard, the present invention substantially fulfills this need. In this respect, the tub toy receptacle according to the present invention substantially departs from the conventional concepts and designs of the prior art, and in doing so provides an apparatus primarily developed for the purpose of storage of toys within a character-shaped device configured to hang upon the bathtub sidewall.

SUMMARY OF THE INVENTION

In view of the foregoing disadvantages inherent in the known types of toy storage units now present in the prior art, the present invention provides an improved tub toy receptacle, and overcomes the above-mentioned disadvantages and drawbacks of the prior art. As such, the general purpose of the present invention, which will be described subsequently in greater detail, is to provide a new and improved tub toy receptacle which has all the advantages of the prior art mentioned heretofore and many novel features that result in a tub toy receptacle which is not anticipated, rendered obvious, suggested, or even implied by the prior art, either alone or in any combination thereof.

To attain this, the present invention essentially comprises a receptacle base having an integrated hook and toy receptacle, where the combination is formed in the shape of a child-pleasing character or figure.

There has thus been outlined, rather broadly, the more important features of the invention in order that the detailed description thereof that follows may be better understood and in order that the present contribution to the art may be better appreciated.

The invention may also include means to adjust the length of the hook or the volume and shape of the receptacle. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tub toy receptacle that has all of the advantages of the prior art toy storage units and none of the disadvantages.

It is another object of the present invention to provide a new and improved tub toy receptacle that may be easily and efficiently manufactured and marketed.

An even further object of the present invention is to provide a new and improved tub toy receptacle that has a low cost of manufacture with regard to both materials and labor, and which accordingly is then susceptible of low prices of sale to the consuming public, thereby making such tub toy receptacle economically available to the buying public.

Still another object of the present invention is to provide a new tub toy receptacle that provides in the apparatuses and methods of the prior art some of the advantages thereof, while simultaneously overcoming some of the disadvantages normally associated therewith.

Lastly, it is an object of the present invention to provide a new and improved method of encouraging children to pick up and put away their bathtub toys.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
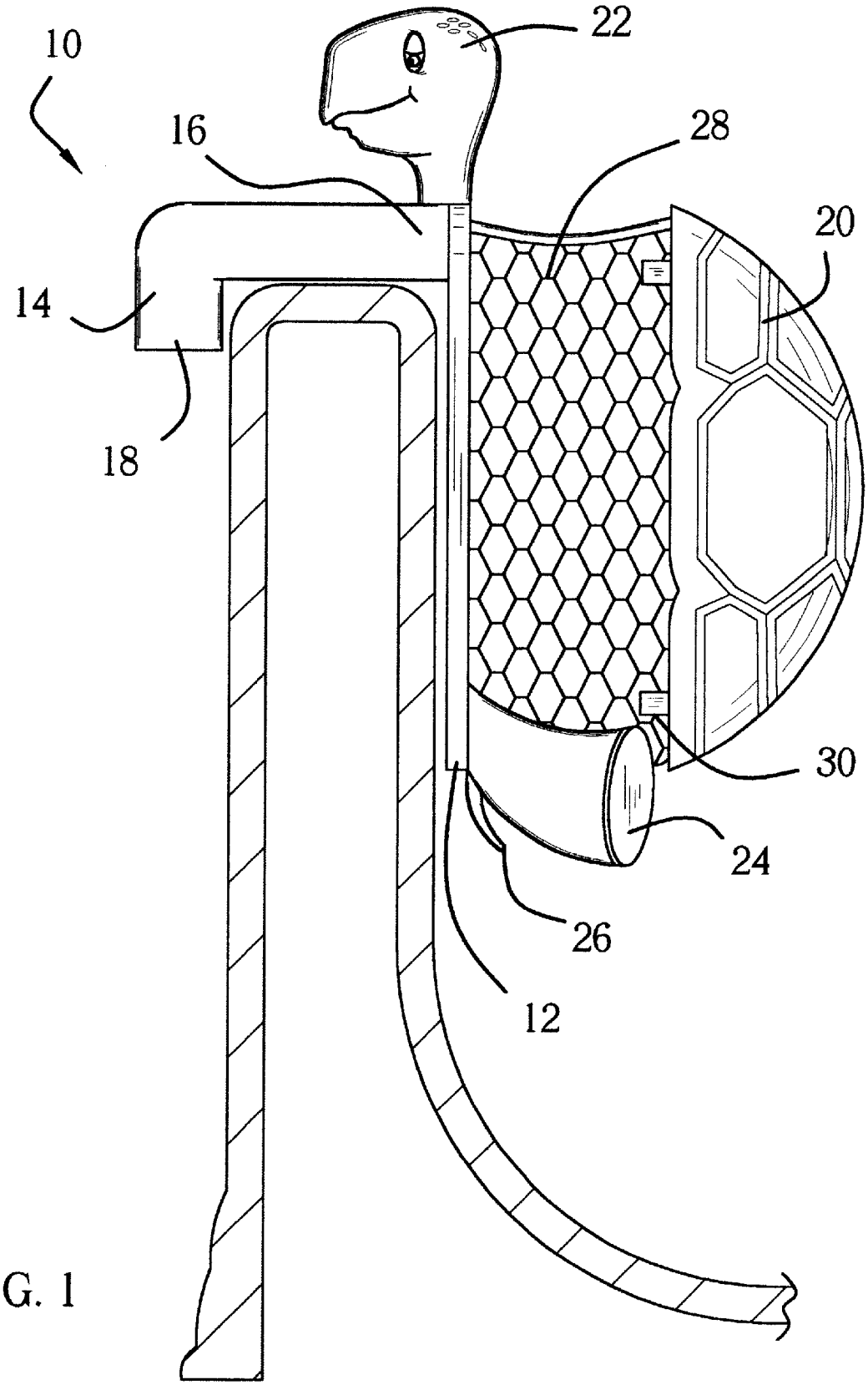
FIG. 1 is a side view of an embodiment of the receptacle of the present invention while the toy tub receptacle is on a bathtub sidewall.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Referring now to the drawings, and particularly to FIGS. 1–4, a preferred embodiment of the tub toy receptacle of the present invention is shown and generally designated by the reference numeral 10.

In FIG. 1, a new and improved tub toy receptacle 10 of the present invention for storage of children's bath time toys is illustrated and will be described. Shown is a preferred embodiment in which the tub toy receptacle 10 is in the shape of a turtle. However, other characters may also be used. The tub toy receptacle of the present invention includes a receptacle base 12. Such a receptacle base is designed to rest against a tub sidewall. That is, the receptacle base is designed to be inside the bathtub, against the sidewall. The receptacle base is constructed from a rigid, yet substantially unbreakable, material such as plastic. However, other materials may be used such as wood or composite. In a preferred embodiment, the receptacle base may be from 12 to 14 inches high, 8 to 10 inches long and 10 to 12 inches wide.

In an embodiment, the receptacle base 12 is substantially plate like. That is, the receptacle base 12 is substantially planar. In a preferred embodiment, the receptacle base 12 is substantially rectangular. However, the receptacle base is not necessarily either planar or rectangular. The receptacle base may be of any configuration that is substantially conformal to a bathtub sidewall. Further, the receptacle base 12 may be of any desired shape. In this manner, various character shapes may be formed from receptacle base 12. The character head 22 may most easily identify the character, which is a turtle in the illustrated preferred embodiment. The character head 22 may be of any non-breakable material. In a preferred embodiment, the character head 22 is of a relatively soft, malleable material such as a vinyl.

Rigidly attached to the receptacle base 12 is tub edge hook 14. Tub edge hook 14 has a proximal end 16 and a distal end 18 where the proximal end 16 is attached to the base, and the distal end extends from the base and wraps around the bathtub sidewall such that the receptacle base is supported. The distal end 18 may be configured so as to resemble a character's appendage. For example, in the preferred embodiment shown, the distal end 18 appears to be turtle "feet", and the remainder of the tub edge hook 14 appears to be turtle legs. The tube edge hook is constructed of a rigid yet substantially unbreakable material such as plastic or composite. However, the entirety of the tub edge hook 14 is not necessarily of the same material. For example, the distal and proximal ends of the hook may be of differing materials or they may not themselves be of completely homogenous material. For example, a portion of the distal end 18 may be a soft vinyl material such that character appendages may be more closely represented.

The tub edge hook 14 may be of a variable length such that bathtubs of varying sidewall thicknesses may be accommodated. For example, that portion of the tub edge hook 14 that rests above a tube sidewall may be substantially cylindrical. Further, that portion may include, for example, two diameters cylindrical tubing, one inside the other. That is, one portion of tubing may be attached to the proximal end 16, where the other portion is connected to the distal end 18. The portions could slide relative to one another such that the distance between the proximal end 16 and the distal end 18 is variable. Of course, alternate configurations that would allow the distance to vary are possible; the tub edge hook 14 is not necessarily cylindrical.

Also attached to receptacle base 12 is receptacle 20. In the preferred embodiment shown, the receptacle 20 is shaped like a turtle's shell. However, in alternate embodiments, the receptacle 20 may be shaped as another character's torso. The receptacle 20 may be of any unbreakable material. That is, the receptacle 20 may be of any material that will not break into sharp pieces that could be dangerous in a bathtub. Such materials may include, but are not limited to, molded plastics, injected plastics, composites, wood, vinyl and the like.

In the preferred embodiment shown, the receptacle is affixed to the receptacle base 12 via a net 28. Such net allows the receptacle to expand to hold a variety of toys in a variety of shapes. Further, the net allow for air circulation to dry the toys. However, the net is not necessary. For example, in an embodiment the receptacle may extend rigidly form the receptacle base. That is, the receptacle may include its own attached, extending opposed sidewalls flanking the receptacle in lieu of the net shown.

In an embodiment including the net 28, attached to the receptacle 20 may be tab closures 30. Such tab closures may insert into slots in the receptacle base. Such configuration allows the tub toy receptacle 10 to be put into a closed position. Other closure means may also be incorporated. For example, hook and loop closures may also be utilized.

Figure 2:
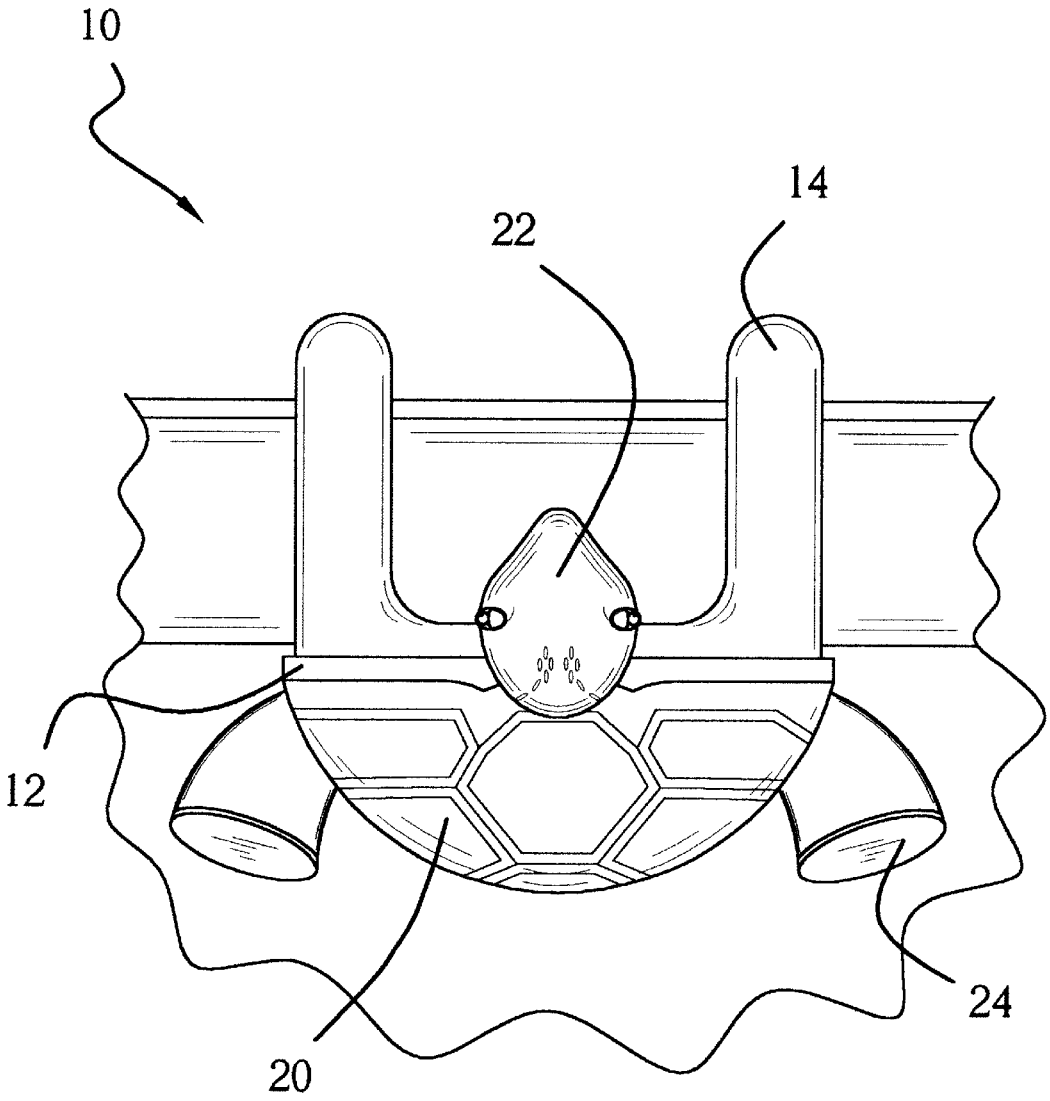
FIG. 2 is a plan view of an embodiment of the receptacle of the present invention while the toy tub receptacle is on a bathtub sidewall.
Figure 3:
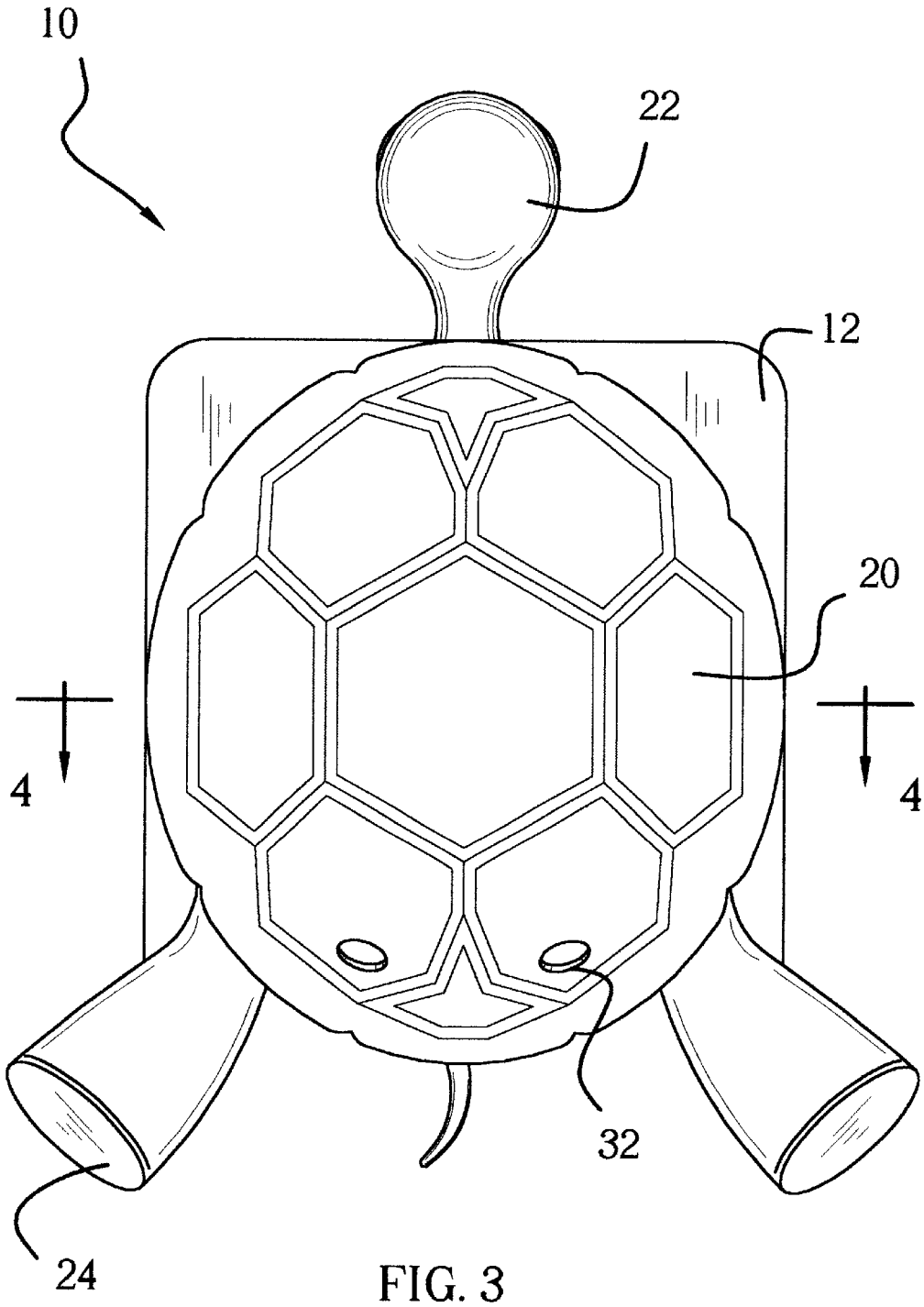
FIG. 3 is a back view of an embodiment of the receptacle of the present invention.
Figure 4:
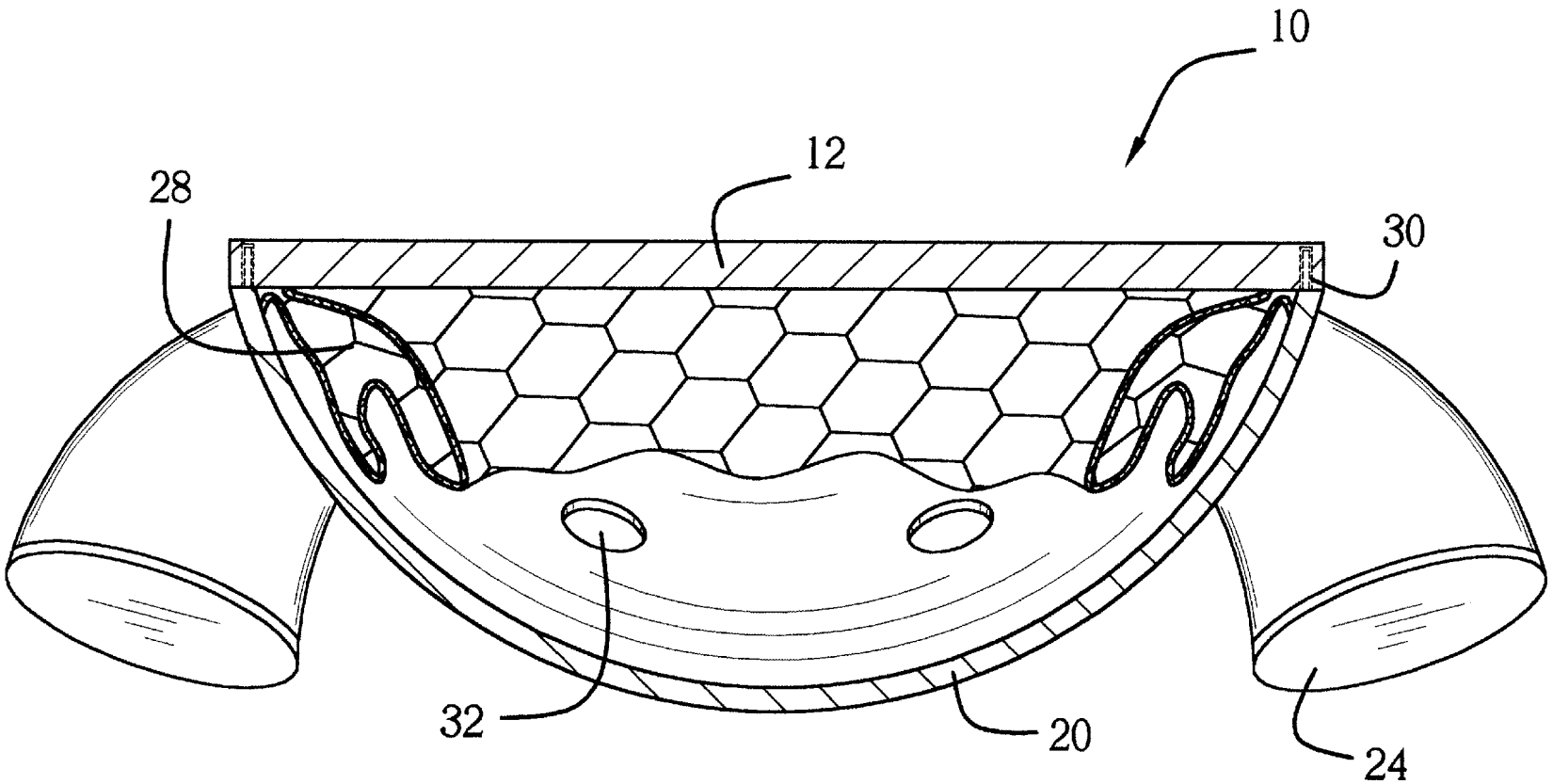
FIG. 4 is a cross-section view of an embodiment of the receptacle of the present invention. The cross-section is taken on line 4 of FIG. 3.

FIG. 2 illustrates a top-down view of the tub toy receptacle. The receptacle 20 is shown in the closed position as described above. FIG. 3 illustrates a back view of the tub toy receptacle 10. Also shown in this view is drain holes 32. Such drain holes are located at the lower portion of the receptacle 20 and may vary in size and number. FIG. 4 illustrates a cross section view of the tub toy receptacle 10 taken on line 4 of FIG. 3. In this view, the tab closures 30 may be seen arranged within slots in the receptacle base 12. Also, net 28 is shown in a folded position. It can be seen that net 28 is affixed to the receptacle base as well as to the receptacle 20. Net 28 may be of any suitable natural or synthetic material, such as cotton or nylon.

In use, it can now be understood that the tub toy receptacle of the instant application provides a child-engaging character to hold toys between baths. Such a receptacle will encourage children to pick up their toys following bath time, and thus will instill good habits. While a preferred embodiment of the tub toy receptacle has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or wood may be used for construction of the base and appendages instead of the materials described. And although storage of bath toys has have been described, it should be appreciated that the tub toy receptacle herein described is also suitable for storage of, for example, swimming pool toys. Furthermore, a wide variety of natural and synthetic materials may be used for the netting instead of the materials described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for storing toys used at bath time comprising:

a receptacle base, wherein the receptacle base is configured to rest against an inner sidewall edge of a bathtub;

a tub edge hook, wherein the hook has a proximal end and a distal end, wherein the proximal end is fixably attached to the receptacle base, wherein the tub edge hook extends across and around a tub edge such that the distal end rests against an outer sidewall edge of the bathtub and is linearly adjustable such that a variety of bathtub sidewall thicknesses may be accommodated, and wherein the tub edge hook is configured to resemble character legs; and a toy receptacle, wherein the toy receptacle is attached to the receptacle base such that the toy receptacle is on one side of the receptacle base and the sidewall edge of the bathtub is on the other side of the receptacle base; and head mounted upon the receptacle base such that the character head extends above the bathtub sidewall.

2. The device as recited in claim 1, further comprising at least one character body part mounted upon the receptacle base such that the character body part extends from the sidewall toward the bathtub opening.

3. The device as recited in claim 2, wherein the toy receptacle is in the shape of a character torso.

4. The device as recited in claim 3, wherein the character is a turtle.

* * * * *